US007900420B2

(12) United States Patent
Pope

(10) Patent No.: US 7,900,420 B2
(45) Date of Patent: Mar. 8, 2011

(54) HAMMER DRILL ATTACHMENT AND METHOD

(76) Inventor: Donald A. Pope, Ocilla, GA (US)

( * ) Notice: Subject to any disclaimer, the term of this patent is extended or adjusted under 35 U.S.C. 154(b) by 26 days.

(21) Appl. No.: 12/550,085

(22) Filed: Aug. 28, 2009

(65) Prior Publication Data

US 2010/0050566 A1 Mar. 4, 2010

Related U.S. Application Data

(60) Provisional application No. 61/092,841, filed on Aug. 29, 2008.

(51) Int. Cl.
*E04F 21/00* (2006.01)
*E04G 21/14* (2006.01)

(52) U.S. Cl. ..... 52/749.11; 52/749.1; 52/747.1; 52/747.11; 227/147; 227/148; 173/13; 173/90; 173/213; 173/170

(58) Field of Classification Search ..... 52/745.2, 52/746.1, 746.12, 747.1, 747.11, 748.1, 749.1, 52/749.11; 227/140–141, 147–148; 254/1; 173/13, 90, 213, 170
See application file for complete search history.

(56) References Cited

U.S. PATENT DOCUMENTS

| | | | | | |
|---|---|---|---|---|---|
| 2,405,110 | A * | 8/1946 | Bullock | 173/141 |
| 2,643,068 | A * | 6/1953 | Harris, Jr. | 242/431 |
| 3,232,346 | A * | 2/1966 | Wakefield, Jr. | 166/344 |
| 3,678,645 | A * | 7/1972 | Valdes | 52/749.11 |
| 3,759,624 | A | 9/1973 | Hundey et al. | |
| 3,769,682 | A * | 11/1973 | Carver | 29/255 |
| 5,295,620 | A * | 3/1994 | Cousineau et al. | 227/156 |
| 5,329,802 | A | 7/1994 | Nunez | |
| 5,979,854 | A * | 11/1999 | Lundgren et al. | 248/354.3 |
| 6,039,371 | A * | 3/2000 | Smith | 294/8.6 |
| 6,047,520 | A * | 4/2000 | Caraballo | 52/749.11 |
| 7,082,662 | B2 * | 8/2006 | Gauntt et al. | 29/402.08 |
| 7,191,685 | B2 | 3/2007 | Lowther | |
| 7,621,100 | B2 * | 11/2009 | Kufner et al. | 52/749.11 |
| 7,743,683 | B2 * | 6/2010 | Dayton et al. | 81/52 |
| 2005/0263746 | A1 * | 12/2005 | Carbajal | 254/200 |

* cited by examiner

*Primary Examiner* — Jeanette E. Chapman

(74) *Attorney, Agent, or Firm* — Brian D. Bellamy

(57) ABSTRACT

A pressure joining method includes a hammer drill attachment device mountable within the chuck of a hand-held hammer drill. Using the hammer drill attachment, an operator installs flooring sheets onto a hook and loop flooring subfloor. The hammer drill attachment includes a shaft for mounting the attachment within the chuck. The hammer drill imparts vibration to the shaft when operated. An angled body member is attached to the shaft and extends downward toward a foot assembly having a foot pad means. The foot assembly vibrates when the hammer drill is actuated to cause the foot pad means to abut against the overlapping sheets of a flooring system and to press the sheets onto an underlying subfloor, thereby forming a seam between the edges of the floor sections.

4 Claims, 4 Drawing Sheets

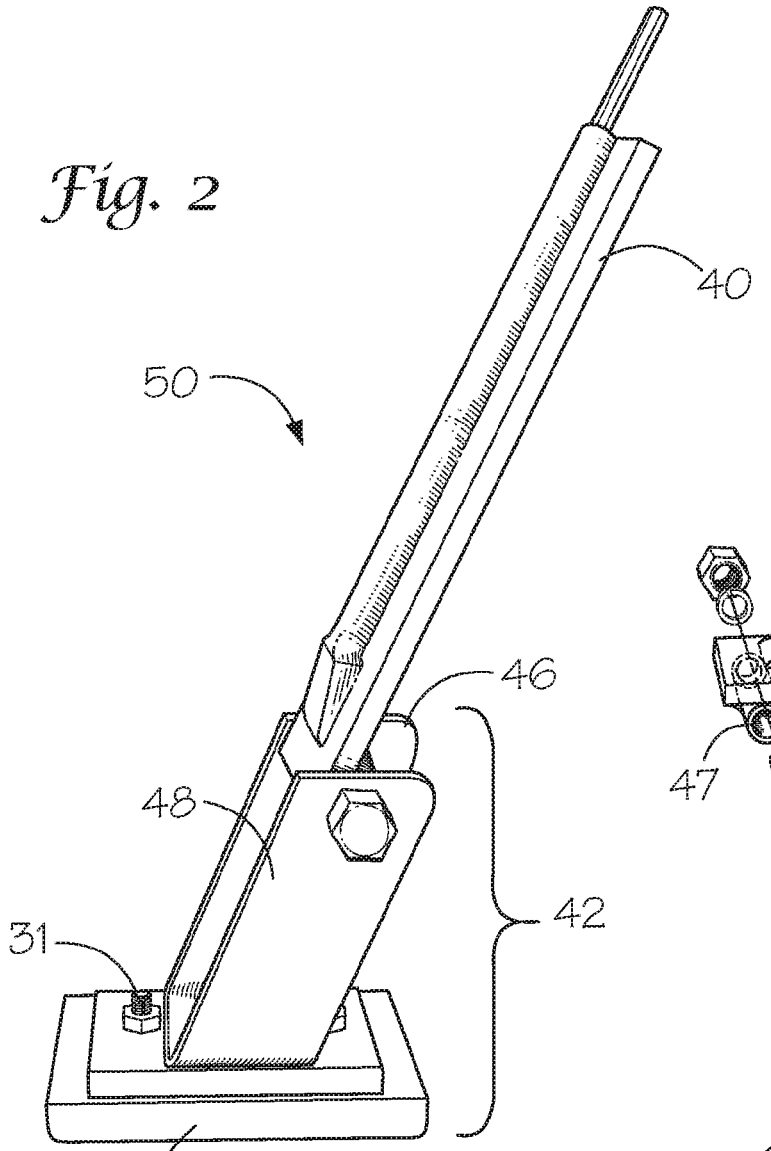
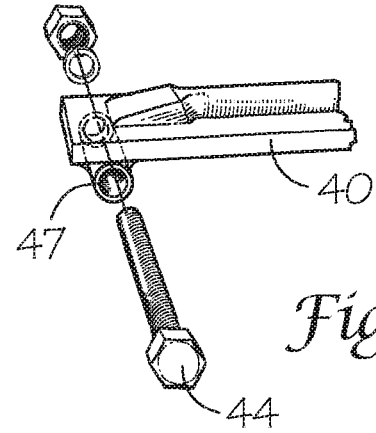
Fig. 4
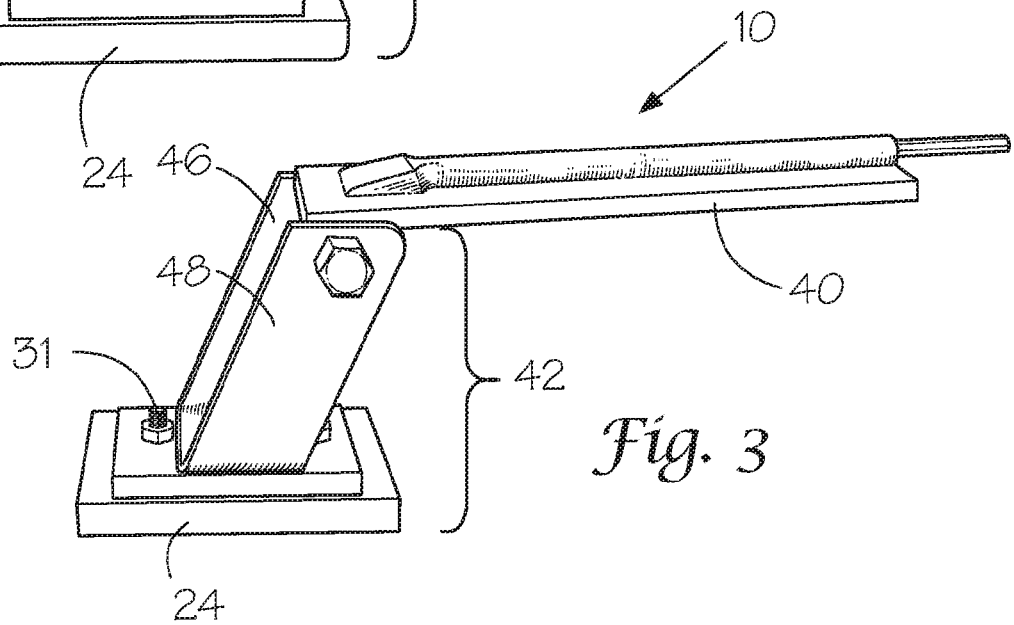
Fig. 3

HAMMER DRILL ATTACHMENT AND METHOD

PRIORITY CLAIM

The present application claims priority of U.S. Provisional Application Ser. No. 61/092,841 filed Aug. 29, 2008.

BACKGROUND OF THE INVENTION

1. Field of the Invention

The present invention relates to hammer drill attachments and methods for installation of sheets of flooring in a hook and loop style flooring system and, more particularly, pertains to a new hammer drill attachment and method of operation thereof for pressure joining overlapping edges of flooring sheets on hook and loop subfloor systems.

2. Description of the Prior Art

In the flooring industry, floors systems are now sometimes being installed by using subfloor systems with hook and loop elements and floor sheets that overlay the subfloor with complimentary hook and loop backing. When installed, the floor sheets are overlapped by a small amount (several millimeters or less). The floor sheets are then pressed onto the subfloor to remove the overlap and form a seam with the edges of the floor sheets abutting together without any noticeable gap, i.e. the floor sheet sections are joined.

Presently the floor sheets are pressed manually using a hand-held tool comprising a handle attached to a metal block with a flat bottom surface. The user presses the floor sheets by repeatedly pounding the hand-held tool onto the edges to form a seam. The present manual process of joining the seams of the floor sheets requires a person to crawl on hands and knees using brute force and is repetitive, arduous work that is very time consuming. An object of the present invention is to enable a person to stand upright and join the edges of flooring sections using a power-driven method and tool.

The various aspects, features and advantages of the present invention will become more fully apparent to those having ordinary skill in the art upon careful consideration of the Detailed Description of the Inventions with the accompanying drawings described below.

SUMMARY OF THE INVENTION

An object of the present invention is to provide a pressure joining tool and method for pressing edges of sheets of a flooring system overlying a hook and loop fastener style subfloor. The present invention provides a hammer drill attachment, mountable within the chuck of a hammer drill. The hammer drill attachment comprises a body having a longitudinally extending body with a shaft extending upwardly for mounting the attachment within the chuck. The body of the attachment has an angled body member attached to the shaft and extending downward toward a foot assembly having a foot pad means. The foot assembly is attached to the angled body member.

The hammer drill imparts vibration to the shaft when actuated, and the foot assembly vibrates to cause the foot pad means to repeatedly press against the edges of the overlapping sheets of a flooring system and to press the sheets together onto an underlying subfloor.

According to the invention, a person operates the tool by actuating the hammer drill while the person is standing upright. The person guides the foot pad means along the overlapping edges. As the foot vibrates along the seam, the flooring sheets are pressed together onto the subfloor into abutting relationship to form a tight and flush seam without any visible gap or overlap of flooring sheets. The process is repeated for each overlapping floor sheets until the flooring is installed on the substrate.

BRIEF DESCRIPTION OF THE DRAWINGS

FIG. 2 is a perspective view of a hammer drill attachment shown in FIG. 1.

FIG. 3 is a perspective view of a hammer drill attachment in accordance with an alternate operating position of present invention.

FIG. 4 is a perspective partial and exploded view of a body member with an attached bracket for receiving an axle shown as comprising a bolt.

DETAILED DESCRIPTION OF THE INVENTIONS

Figure 1:
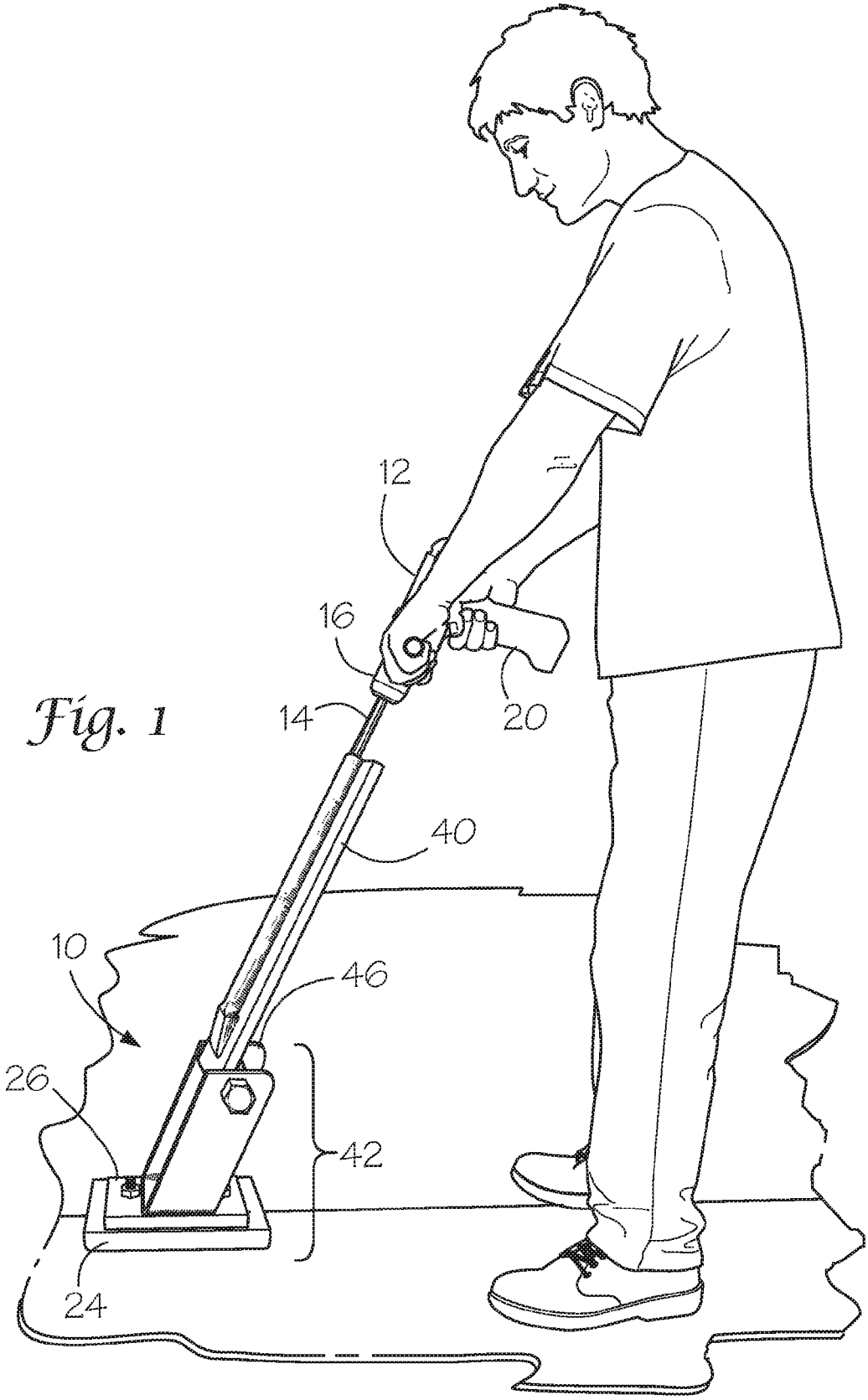
FIG. 1 is a side perspective view of a hand-held hammer drill in combination with a hammer drill attachment according to a preferred embodiment of the present invention shown in use by an operator for the installation of flooring sheets.

Referring now the drawings, and in particular FIGS. 1 through 6 thereof, a new hammer drill attachment embodying the principles and concepts of the present invention and generally designated by the reference numeral 10 will be described. What will also be described is a method for using a hammer drill 12 and the hammer drill attachment 10 in installation of flooring sheets having a hook or loop backing onto a substrate of subflooring having a hook or loop surface layer. The combination of a hammer drill 12 and a hammer drill attachment 10 forms a pressure joining tool for installation of flooring sheets and floor covering sections having hook and loop backing onto a subflooring surface for receiving the flooring sheets.

As illustrated in FIGS. 1 through 6, the hammer drill attachment 10 includes a shaft 14 for universal coupling to a typical hammer drill 12 via a chuck 16. The chuck 16 has a plurality of jaws or other connection mechanism that secure the chuck around the shaft 14 of the hammer drill attachment 10. The shaft 14 has a substantially cylindrical design and has a base end. The base end of the shaft 14 adjoins the body 18 of the attachment 10, and the shaft is arranged to be positioned within the chuck 16 of said hammer drill 12. The hammer drill 12 operates the shaft 14 of the hammer drill attachment 10 to longitudinally oscillate the hammer drill attachment. The operator exerts a pressing force or contact pressure to the hammer drill attachment 10 in the drill chuck 16 via the shaft 14 by holding a handle 20 of the hammer drill 12 while standing upright.

Figure 6:
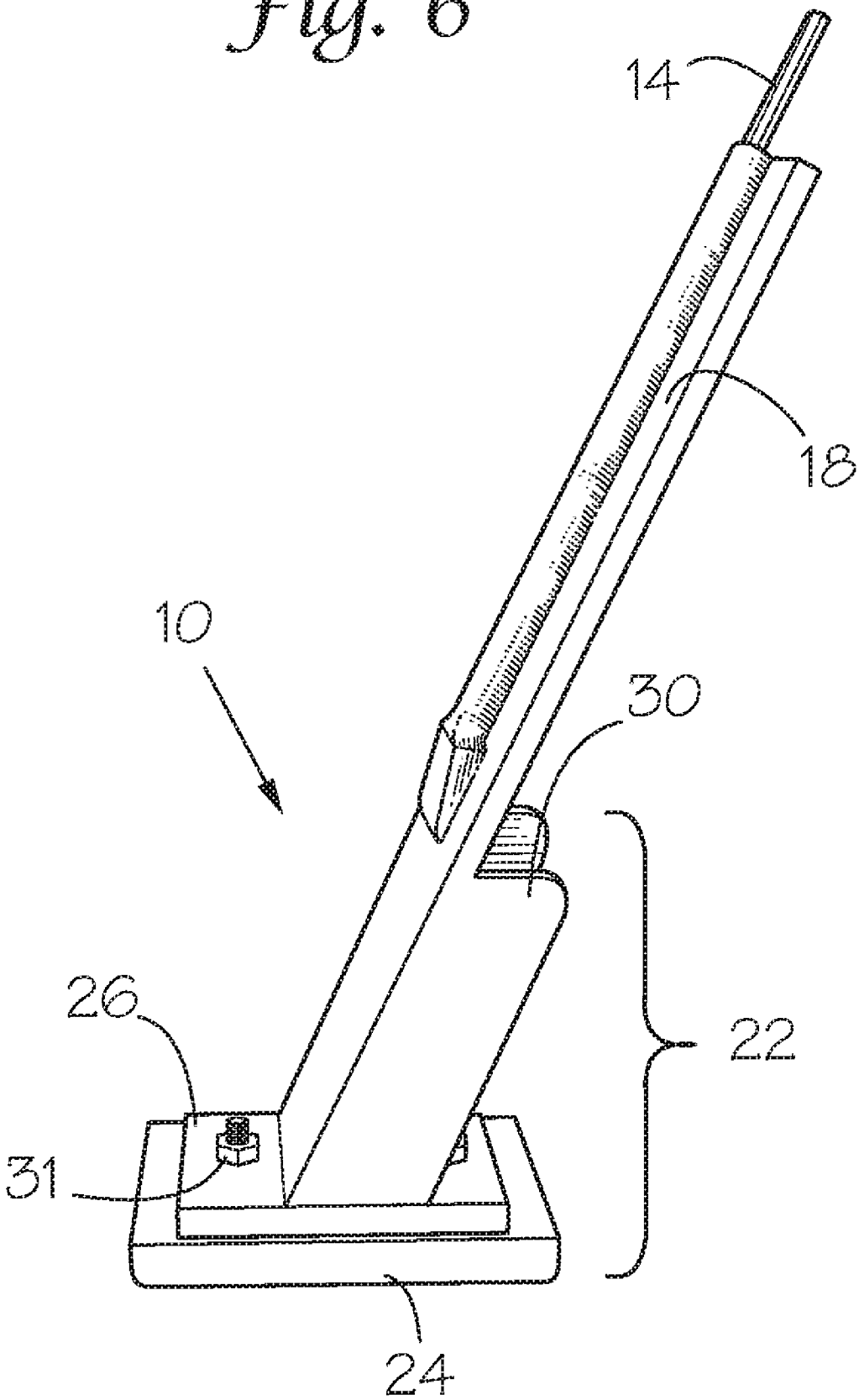
FIG. 6 is a perspective view of an alternative embodiment of a hammer drill attachment according to a preferred embodiment of the present invention.

FIG. 1 is a perspective view of the hammer drill attachment 10 in combination with the hand-held hammer drill 12 according to a preferred embodiment of the invention. As illustrated in FIG. 1, the base end of the shaft 14 adjoins the body member 40 of the hammer drill attachment 10. FIG. 6 illustrates an alternative embodiment with a fixed body member 18. The body member 18 or 40 comprises a reinforced structural member that extends downwardly from the shaft 14 portion that connects the hammer drill attachment 10 to the hammer drill 12. The preferred arrangement of the body member 18, 40 extends at an angle downwardly in longitudinal alignment with the shaft, and the body member 18, 40 terminates at an opposing end from the shaft 14. A foot assembly 22 that is positioned in front of and away from a standing operator attaches to the opposing end of the body member 18, 40. The body member 18, 40 may be reinforced by constructing the body member of sufficient width or thickness or structure, as well as of a sufficiently strong material. The body member 18, 40 is reinforced by construction of metal, such as steel, and being several times wider than the shaft 14 and of about the same width as the foot assembly 22.

The foot assembly 22 illustrated in FIG. 6 adjoins the body member 18 of the hammer drill attachment 10 and provides a reinforced structure for attachment of a foot pad means 24. The foot pad means 24 is functionally arranged on the foot assembly 22 for pressure contact with the flooring sheets 32, 34 for joining overlapping edges 36, 38 of the flooring sheets. The foot assembly 22 includes a mounting plate 26 to which a left support member 28 and a right support member 30 are attached for reinforcement. The mounting plate 26 attaches between the support members 28, 30 by attaching to the bottom edges of the support members while the support members are separated in parallel relationship by a distance about the width of the body member 18. The body member 18 attaches to the front edge of each left and right support members 28, 30 and may be welded to the support members. Or, as shown in FIG. 1, the body member 40 may be pivotally attached to the support members. The mounting plate 26 provides a base for the support members 28, 30 and a structural member to which the foot pad means 24 attaches by means for attaching, such as a nut and bolt combination 31. The foot pad means 24 may comprise a foot pad or other pad-like body of material that is constructed of neoprene or rubber and the foot pad means 24 may be glued, bolted or otherwise attached onto the mounting plate 26 so as to provide the floor impacting bottom surface of the hammer drill attachment 10. The foot pad means 24 vibrates against edges of overlapping floor sections 32, 34 when the hammer drill 12 is actuated and presses the edges onto the subfloor surface so that the edges join in adjacent abutting relation on the subfloor surface.

The body member 18 or 40 of the hammer drill attachment 10 and shaft 14 and foot assembly 22 align as shown in FIGS. 1, 2 and 6 at an angle of about 10 to 40 degrees from vertical to improve the ergonomic function of the hammer drill attachment. The hand-held hammer drill 12 attaches to the hammer drill attachment 10 with such angle and height so that the operator can stand upright and hold the hammer drill by hand comfortably and without contorting the hand downward. The angle of the body member's alignment permits the foot pad means 24 to remain in front of the operator for control while the foot pad means remains with the flat surface of the pad parallel to the flooring surface. Upon operation, the alignment angle causes the foot pad means 24 to impart force in downward and forward directions. The pressure and direction of force installs the floor sections 32, 34 and joins them along a seam more efficiently by assisting movement of the hammer drill attachment 10.

It may be desirable for ergonomic and functional needs to vary the angle of the body 40 and shaft 14 of the hammer drill attachment 10 with respect to the foot assembly 22. An alternative embodiment of the invention is shown in FIGS. 1-5B in which the angle between the body member 40 and foot assembly 42 is adjustable. A pivotal joint is provided connecting the body 40 to the foot assembly 42. The joint comprises an axle, which may comprise a bolt 44 or other axle member through a left support member 46 and right support member 48 and through an aperture provided on a bracket 47 attached to the body member 40, wherein the joint pivotally retains the body member 40 between the support members 46, 48. The angle of the body member 40 with respect to the foot assembly 42 varies by operator movement of the body member 40 on the hammer drill attachment 10. The foot assembly 42 remains situated in a constant alignment with the floor surface and the foot pad means 24 remains parallel with the floor surface.

Figure 5A:
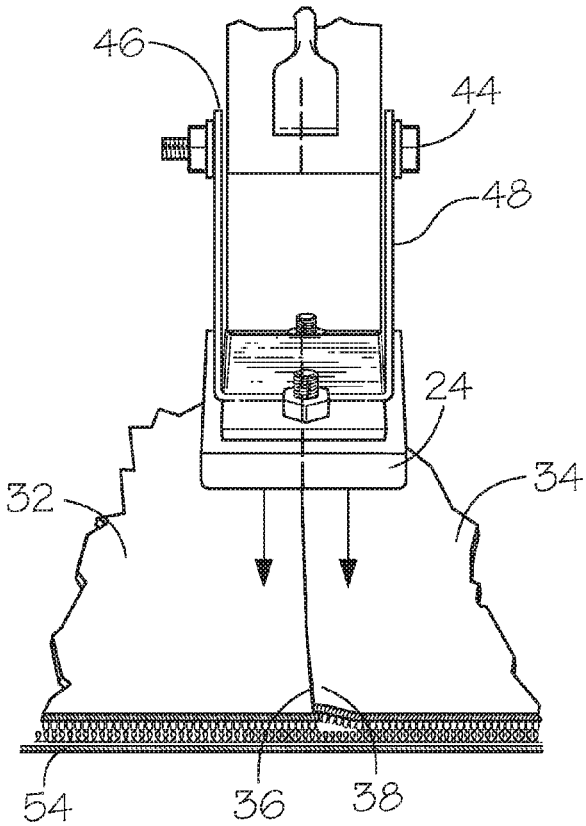
FIG. 5A is a partial perspective view of the hammer drill attachment operating on adjacent sections of floor covering material for pressure joining.
Figure 5B:
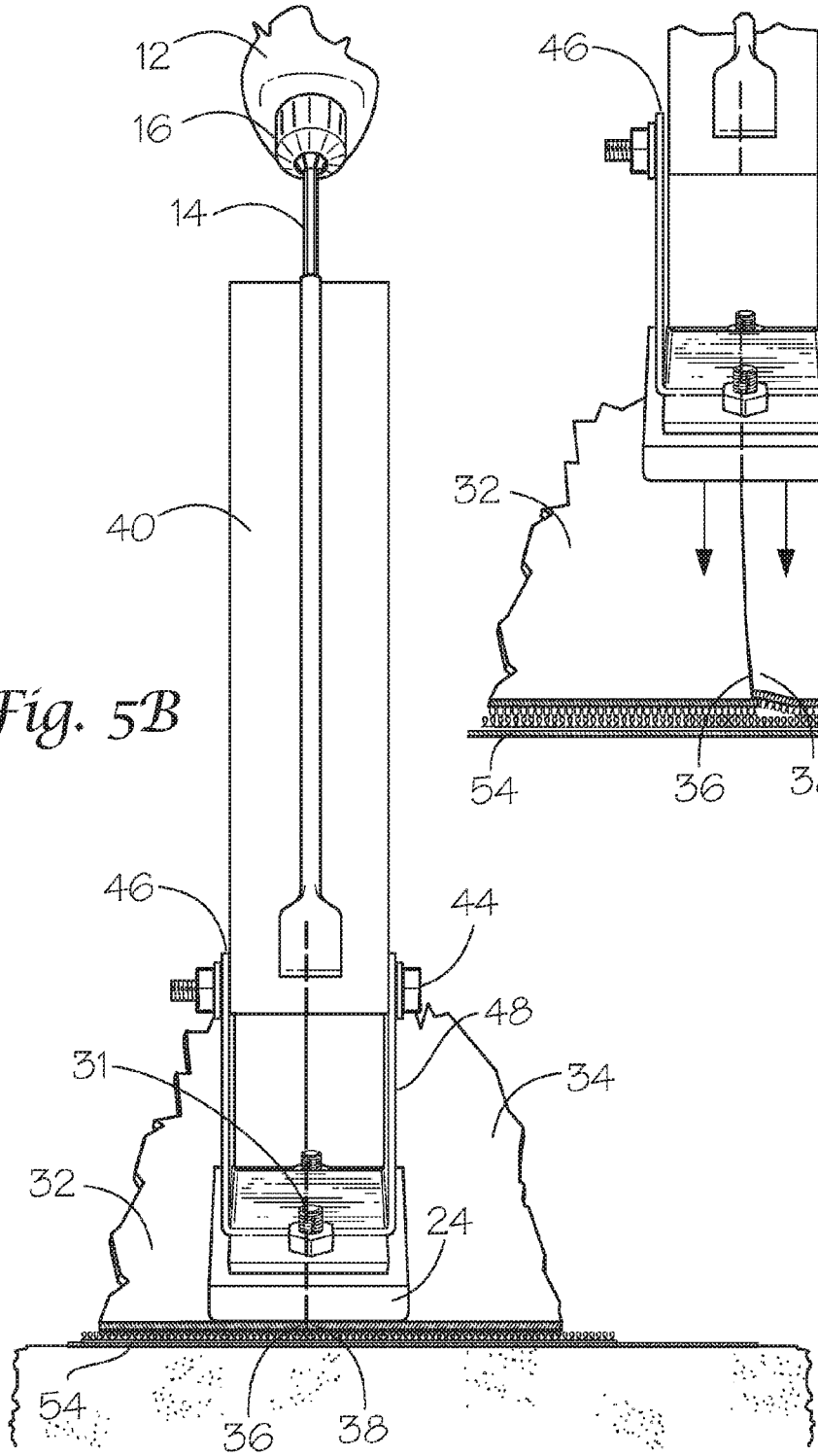
FIG. 5B is a front partial perspective view of the combination of a hand-held hammer drill and the hammer drill attachment in operation.

As the hammer drill 12 vibrates the hammer drill attachment 10, the foot pad means 24 applies pressure to the overlapping edges 36, 38 of floor sections 32, 34 as in FIGS. 5A and 5B. The pressure of the foot pad means 24 vibrations forces these overlapping section edges into adjacent alignment forming a smooth flooring seam 56 between the flooring sections 32, 34, whereby the adjacent flooring sections are virtually joined horizontally edge to edge along the seam.

The invention includes a method for joining floor sections 32, 34 that are installed on a subfloor surface by hook and loop fasteners. Floor sections 32, 34 are arranged onto the subfloor surface with overlapping lengthwise edges 36, 38. The hammer drill attachment 10 is attached to a hand held hammer drill 12, and the operator holds the hammer drill. The hammer drill attachment 10 extends forward at an angle of about 10 to 40 degrees away from the operator's body, and the foot pad means 24 is positioned by the operator to rest flat and parallel to the floor surface. The operator initiates power from the hammer drill 12 to vibrate the hammer drill attachment 10 and impart vibrating force from the foot pad means 24 to the overlapping edges 36, 38 of the floor sections 32, 34. The foot pad means 24 is initially situated over a first end of the overlapping edges 36, 38 of floor sections 32, 34 for movement toward the opposing end. As the foot pad means 24 vibrates, the overlapping edges 36, 38 of the floor sections 32, 34 are forced downward and into abutting edgewise relationship, whereby a seam 56 is formed between the abutting floor section edges without overlap and without any gap exceeding desired tolerances. The operator moves the vibrating foot pad means 24 along the overlapping floor section edges 36, 38. The operator moves the foot pad means 24 by walking along the overlapping floor sections' edges 36, 38 gradually until the sections of flooring being worked on are installed. Installation occurs by continuously forming the seam 56 between adjacent floor sections 32, 34 by removing the overlap of the edges 36, 38 by pressure. Thereby, the edges 36, 38 of floor sections 32, 34 abut to form a lengthwise seam 56 by pressure joining with the hammer drill attachment 10 using the steps described.

I claim:

1. A pressure joining tool for installation of flooring sheets comprising:

a hand-held hammer drill in combination with a hammer drill attachment;

said hammer drill attachment including a body member extending between a shaft and a foot assembly;

a foot pad means arranged on the foot assembly for pressure contact with the flooring sheets for joining overlapping edges of the flooring sheets; and said foot assembly attached to the body member and extending upwardly at an angle of 10-40 degrees from vertical with respect to the foot pad and said shaft includes a first end attached to the body member and the shaft extending upwardly from the body member for mounting a second end of the shaft within a chuck of the hammer drill and for attachment of the hammer drill to the hammer drill attachment.

2. A pressure joining tool as in claim 1 in which said foot assembly includes a mounting plate to which a left support member and a right support member are attached by attaching a bottom edge of each support member to the mounting plate while holding the support members in parallel vertical standing relationship separated by about the width of the mounting plate;

said body member attached to the front edge of both the left support member and the right support member respectively; and said foot pad means being constructed of neoprene or rubber material and attached to a bottom surface of the mounting plate.

3. A pressure joining tool as in claim 2 in which said body member includes a bracket extending rearward and including an aperture through the bracket aligned for receipt of an axle, each of the left and right support members include an aperture in alignment with the bracket aperture for receipt of the axle, thereby the body member is pivotally attached to the support members.

4. A method for pressure joining of flooring sheets onto a hook and loop style subfloor system including the steps of:

providing a hand-held hammer drill and a hammer drill attachment;

providing a pair of the flooring sheets in side-by-side abutting relationship for installation by pressure joining with said pair of flooring sheets having a pair of overlapping edges;

mounting the hammer drill attachment within a chuck of the hand-held hammer drill;

an operator holding a handle of the hand-held hammer drill while standing upright;

said hammer drill attachment including a foot assembly having a foot pad, and the operator positioning the foot assembly with the foot pad resting flatly over a first end of the pair of overlapping edges of said flooring sheets;

actuating the hammer drill and imparting vibration to the shaft;

said imparting of vibration to the shaft causing the foot assembly to vibrate to cause the foot pad to repeatedly press against the overlapping edges of the flooring sheets;

the operator guiding the foot pad along the overlapping edges for movement toward an opposing end of the pair of overlapping edges of said flooring sheets by walking the hammer drill and hammer drill attachment forward along the overlapping edges;

pressing the overlapping edges of the flooring sheets overlying the hook and loop fastener style subfloor into abutting relationship to form a tight and flush seam; and repeating the process for each pair of the flooring sheets having the pair of overlapping edges.

* * * * *